US009447622B2

(12) United States Patent
Hellwig

(10) Patent No.: US 9,447,622 B2
(45) Date of Patent: Sep. 20, 2016

(54) SPRING ADJUSTING DEVICE FOR A DOOR ACTUATING DEVICE

(71) Applicant: DORMA Deutschland GmbH, Ennepetal (DE)

(72) Inventor: Alexander Hellwig, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 37 days.

(21) Appl. No.: 14/538,080

(22) Filed: Nov. 11, 2014

(65) Prior Publication Data

US 2015/0128378 A1 May 14, 2015

(30) Foreign Application Priority Data

Nov. 11, 2013 (DE) ..... 10 2013 112 381

(51) Int. Cl.
*E05F 1/08* (2006.01)
*E05F 1/10* (2006.01)
*E05F 3/10* (2006.01)

(52) U.S. Cl.
CPC ..... *E05F 1/1066* (2013.01); *E05F 3/10* (2013.01); *E05Y 2201/492* (2013.01); *Y10T 16/593* (2015.01)

(58) Field of Classification Search
CPC ..... E05F 1/1066; E05F 3/10; E05F 1/08; E05Y 2201/492; Y10T 16/593
USPC ..... 16/71, 72, 75, 76, 85
See application file for complete search history.

(56) References Cited

U.S. PATENT DOCUMENTS 370,468 A * 9/1887 Griffing ..... E05F 3/20 114/201 R
1,965,805 A * 7/1934 Riggins ..... E05F 3/108 16/52
2,325,711 A * 8/1943 Seaman ..... E05F 3/10 16/54
2,493,115 A * 1/1950 Diebel ..... E05F 3/20 16/300
3,714,677 A * 2/1973 Schmid ..... E05F 3/102 16/52
3,911,527 A 10/1975 Lasier
4,483,043 A * 11/1984 Tillmann ..... E05F 3/104 16/48.5
4,590,639 A * 5/1986 Fritsche ..... E05F 3/10 116/204
4,663,800 A * 5/1987 Mettenleiter ..... E05F 3/221 16/51
5,802,670 A * 9/1998 Bienek ..... E05F 3/10 16/53
5,901,412 A * 5/1999 Jentsch ..... E05F 3/104 16/53
2010/0212109 A1 * 8/2010 Kim ..... E05F 5/006 16/85

* cited by examiner

*Primary Examiner* — Roberta Delisle
(74) *Attorney, Agent, or Firm* — Cantor Colburn LLP

(57) ABSTRACT

A door actuating device, including a housing, at least one drive unit which is disposed in the housing and can be coupled to a door leaf, and at least one spring energy accumulator, which is in operative connection with the drive unit, and which includes a spring disposed therein under spring pretension, wherein the spring pretension of the spring is realized by means of a spring adjusting device, which includes at least one screwed sealing plug, which can be connected to the housing, and an adjusting nut, where a cylinder is configured at the screwed sealing plug and oriented towards the spring, at which cylinder the adjusting nut is linearly guided, where a setting element which is guided by means of the screwed sealing plug and, at least in sections, can be brought non-positively and positively into engagement with the cylinder, and which bears against the adjusting nut, serves for adjusting the spring pretension.

10 Claims, 3 Drawing Sheets

SPRING ADJUSTING DEVICE FOR A DOOR ACTUATING DEVICE

CROSS REFERENCE TO RELATED APPLICATION

This application is related to and claims the benefit of German Patent Application Number 102013112381.3 filed on 11 Nov. 2013, the contents of which are herein incorporated by reference in their entirety.

TECHNICAL FIELD

The invention relates to a door actuating device comprising a housing, at least one drive unit which is disposed in the housing and can be coupled to a door leaf, and at least one spring energy accumulator, which is in operative connection with the drive unit, and which includes a spring disposed therein under a spring pretension, wherein the spring pretension of the spring is realized by means of a spring adjusting device, which comprises at least one screwed sealing plug, which can be connected to the housing, and an adjusting nut.

BACKGROUND

Such door actuating devices are well known and are likewise designated as door drives or as door closers. A distinction should be made, in particular between door actuating devices comprising an electro-hydraulic unit, which also allow for opening the doors via the door actuating device, whereas devices without an electro-hydraulic drive simply control the kinematics of the door closing movement. The known door actuating devices have in common that they include a spring energy accumulator, which, in the form of mechanical work, stores the energy required for the closing movement of the door. In this case, storing the mechanical work is realized by means of at least one spring, which is preferably configured as a compression spring, which is tensioned during the opening movement of the door. The compression spring relaxes during a closing movement of the door, whereby the stored mechanical work, in the form of energy, is released and effects the closing movement of the door.

The door actuating devices may be either inserted into the door frame or incorporated into the door leaf itself. When utilizing the known door actuating devices in fire-rated doors, minimum closing moments of the doors need to be achieved, wherein these moments depend on the width and the weight of the doors. In this case, requirements are to be respected, which relate for example to the availability of energy mechanically stored in the door actuating devices, such that a fire-rated door autonomously executes a closing procedure of the door even in the event of power failure and thus in the event of a possible control failure of the door actuating device. In order to create uniform actuating devices of the door leaves for a plurality of variants of different door widths and door weights, spring adjusting devices are provided by means of which the initial tensile force of the compression spring can be adjusted, which spring stores the mechanical energy to provide a minimum closing momentum of the door leaf.

A spring adjusting device is known from the utility model DE 92 09 276 U1, which comprises a supporting ring on which the end side of the compression spring rests. The supporting ring has a female thread into which a spring adjusting device is screwed, wherein the spring adjusting device is disposed to be axially fixed in a closing screw at the end side of the housing of the device. By rotating the spring adjusting device, the supporting ring is caused to move axially, such that the compression spring is compressed, respectively relaxes. In this case, the supporting ring is able to rotate, as long as it is not axially guided in a complex manner inside the housing via corresponding guiding grooves.

A door closer with an adjustable closing force is known from the document DE 32 24 300 C2. This door closer comprises at least one compression spring disposed in the closer housing and bearing with one end against an adjustable plate, and a device for adjusting the plate which can be actuated from outside the housing. In this case, the plate is disposed on a rotatably supported and drivable threaded spindle, wherein the spring plate, disposed on a threaded spindle, is driven via a worm gear. This complex configuration, in particular the worm gear requires considerable space, because a drive worm, which is disposed tangentially with regard to the worm wheel, cannot be incorporated into a small installation space.

Therefore, the known state-of-the-art is disadvantageous in that the embodiments for spring force adjusting devices require enormous installation space on the one hand, such that a narrow built embodiment of a door actuating device is not possible in order to incorporate the latter preferably into a door leaf or, in more general terms, into a location where only a very limited installation space is available. On the other hand, the known door actuating devices require considerable technical expense in terms of manufacturing.

BRIEF SUMMARY

The invention provides a door actuating device with a spring adjusting device, which overcomes the disadvantages known in the state-of-the-art. In addition, the invention reduces the technical expense in terms of manufacturing by redesigning the spring adjusting device.

The invention includes the technical teaching that a cylinder is configured at the screwed sealing plug and oriented towards the spring, at which cylinder the adjusting nut is linearly guided, wherein a setting element which is guided by means of the screwed sealing plug and, at least in sections, can be brought non-positively and positively into engagement with the cylinder, and bears against the adjusting nut, serves for adjusting the spring pretension.

This solution offers the advantage that a spring adjusting device is provided, which takes up little construction space and which, on account of the setting element which is guided by means of the screwed sealing plug and bears against the adjusting nut and serves for setting the spring pretension, offers a simple solution in terms of manufacturing. By means of the setting element, which, at least in sections, can be non-positively and/or positively brought into engagement with the cylinder, wherein the setting element bears against the adjusting nut, which is slidably retained on the cylinder, by the driving force of the setting element, the adjusting element is allowed to follow the driving force of the setting element in the direction of the spring. In this case, the spring is compressed by means of the spring support configured at the adjusting element. In so far the advance of the setting element equals the displacement of the compression of the spring. Thereby, the adjusting displacement of the spring, respectively of the adjusting element which compresses the spring, can be verified by measuring, in an advantageous manner, the insert depth of the setting element in the screwed sealing plug. In addition, it is advantageous that an anti-rotation protection inside the screwed sealing plug, respectively the adjusting screw becomes redundant, because no major requirements are necessary for internal geometrical shapes, as they are known from the state-of-the-art. Moreover, by simply modifying the length of the screw, different adjusting lengths can be realized, which allows for the inventive spring adjusting device to become a universal product-wide applicable component.

Since, in the inventive spring adjusting device, the adjusting nut is linearly and tightly guided on a cylinder, wherein said cylinder is a part of the screwed sealing plug, the inventive door actuating device, in this case, in particular the adjusting nut, do not have to be protected against rotation. This is achieved in that the setting element, which is guided by means of the screwed sealing plug, pushes against the adjusting nut, wherein the adjusting nut is guided in the direction of the spring allowing for adjusting the spring. Correspondingly even without any particular design, the inventive door actuating device can be used for example as an adjusting nut, which is formed as a polygon, also for setting of springs, in which the press force thereof would not be sufficient to prevent the adjusting nut in the door actuating device from rotating along.

The setting element is preferably guided in a bore of the cylinder, wherein the bore, at least in sections, includes a female thread, which can be brought into non-positive engagement with a corresponding thread, which, at least in sections, is configured at the setting element. By defining said thread, namely the pitch thereof, in this case in a preferred manner, the section-wise driving force of the setting element can be set from thread fillet to thread fillet. With the advance, respectively the screwing-in of the setting element, the adjusting element, against which the setting element bears, is moved, via the advance of the setting element, in the direction of the spring. For this purpose, preferably below the spring seating, the adjusting nut is formed as a tenon which, at least partially, surrounds the cylinder of the screwed sealing plug and the setting element, which is introduced by means of the screwed sealing plug. In this case, the setting element, preferably with one of its ends, bears against a bottom formed by the tenon within the adjusting nut and against said bottom. Advantageously, as the tenon extends towards the screwed sealing plug in a spring seating, wherein the spring seating is moved along with the advance of the setting element, which comes to abut at the bottom of the tenon, whereby the spring is compressed as well.

Preferably, the tenon extends, at least in sections, into the spring, such that the spring encloses the tenon. Therefore the spring adjusting device of the present invention has a particularly small structural shape, because both the adjusting element with its tenon and the setting element are, at least in sections, disposed within the spring.

Another reduction of the structural shape dimension is achieved in that the screwed sealing plug, the cylinder thereof extending together with the adjusting element into the spring and at which the adjusting element is linearly guided, is configured as a housing cover for one end of the housing of the door actuating part. Preferably, the screwed sealing plug includes a male thread for this purpose, which is screwed into a female thread of the housing of the door actuating part.

As conventionally the springs are supported in oil-filled bearings, in its section configured as a housing cover, the screwed sealing plug includes at least one sealing ring, which is located between the screwed sealing plug and the interior walling of the housing. Preferably, the circumference, i. e. the sections protruding beyond the cylinder, of the housing cover, which is formed by the screwed sealing plug, is adapted to the circumference of the housing of the door actuating part.

As already described, the insert depth and, in this case in particular the screw-in depth of the setting element into the screwed sealing plug serves to verify the adjusting displacement of the adjusting nut. Preferably, for this purpose the setting element is guided in the center by means of the screwed sealing plug. More precisely, the setting element is guided in a bore which extends through the screwed sealing plug. Therefore, the setting element can be manipulated on the exterior side of the housing cover which is formed by the screwed sealing plug.

Advantageously, the setting element is a screw, the threads thereof being brought into positive engagement with the female thread of the cylinder of the screwed sealing plug. By rotating the screw from the outside at the housing cover, which is formed by the screwed sealing plug, the screw can be turned in the direction of the spring. In this case, as the screw bears against the bottom of the tenon of the setting element, the screw entrains the adjusting element and the spring seating which is formed together with the adjusting element, whereby the spring is compressed, respectively the door actuating part is adjusted corresponding to the requirements, which are predetermined by the respective conditions.

Preferably, the spring is a compression spring. By compressing the compression spring, namely by means of the adjusting element, which is pressed into the spring by means of the screw, respectively the setting element with its tenon, and entrains the spring seating, the compression spring can be adjusted to the desired pretension. In this case, the pretension of the compression spring is set such that the energy, to be stored upon opening the door for closing a door leaf thereafter, is sufficient to automatically close the door leaf again.

However, the spring may be a tension spring as well. Likewise, the spring energy accumulator, i. e. the spring of the spring energy accumulator may be replaced by other force storing, respectively by energy storing elements.

BRIEF DESCRIPTION OF THE DRAWINGS

Hereinafter, further measures enhancing the invention will be illustrated in detail in conjunction with the description of one preferred embodiment of the invention based on the Figures, in which.

DETAILED DESCRIPTION

Figure 1:
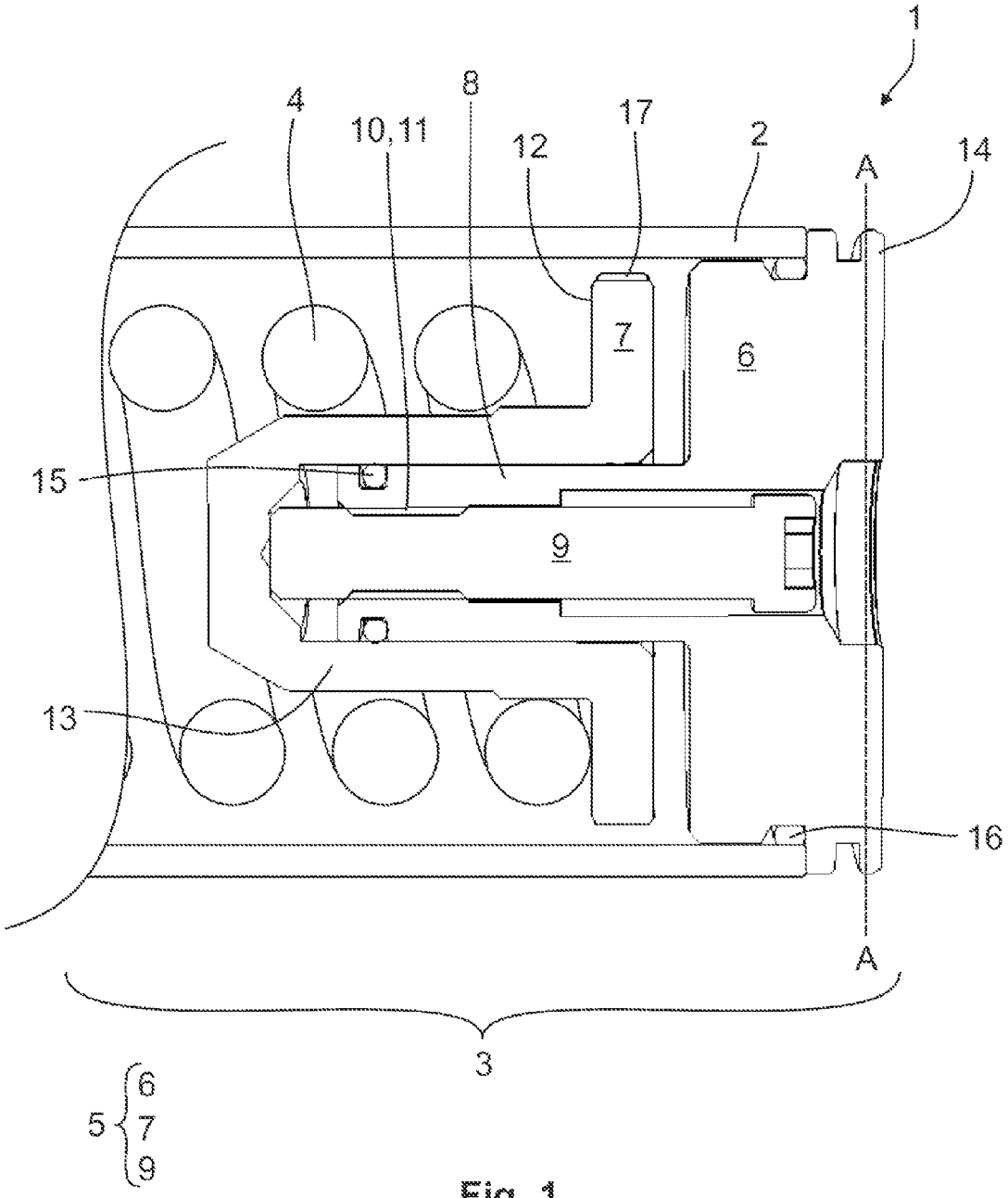
FIG. 1: shows a spring energy accumulator in a door actuating part in a lateral sectional view.

Throughout the different Figures, same parts are always identified by the same reference numerals, and therefore, normally they will be only described once.

FIG. 1 shows a door actuating device 1, wherein in this case only one part of the door actuating device 1, namely the spring energy accumulator 3 is illustrated. In this case, the door actuating device 1 comprises a housing 2 in which in a usual manner a drive unit is disposed, which in this case is not illustrated, via which a door leaf can be coupled. The part of the door actuating device 1 illustrated in the Figure, namely the spring energy accumulator 3 which is disposed in the same housing 2 as the drive unit, is in operative connection with the drive unit. A spring 4 is disposed within the housing 2, wherein the spring 4 is preferably a compression spring which is under spring pretension. The spring pretension of the spring 4 is realized by means of a spring adjusting device 5, which comprises a screwed sealing plug 6 and an adjusting nut 7. As illustrated in the Figure, the screwed sealing plug 6 is configured as a housing cover 14, which closes one end of the housing 2 of the door actuating device 1. For this purpose a sealing ring 16 is configured at the screwed sealing plug 6, between the housing cover 14 of the screwed sealing plug 6 and the housing 2, in order to prevent oil from leaking from the spring energy accumulator 3. Seen towards the spring 4, the screwed sealing plug 6 transitions from the housing cover 14 to a cylinder 8, which is configured in the direction of the spring 4. The adjusting nut 7 is linearly guided at the cylinder 8. The adjusting nut 7 includes a spring seating 12, at which the spring 4 comes to rest. Within the spring 4, starting at the spring seating 12 the adjusting nut 7 extends and transitions into a tenon 13, which extends into the spring 4 and has a bottom. A gasket 15, in the shape of a sealing ring is supported in a recess of the cylinder 8 of the screwed sealing plug 6 between the cylinder 8 of the screwed sealing plug 6 and the tenon 13 of the screwed sealing plug 6. The gasket 15 at the cylinder 8 of the screwed sealing plug 6 serves the purpose of preventing oil from leaking into the hollow space, which in this case, as illustrated in FIG. 1, is formed on the left side of the gasket, between the tenon 13 and the cylinder 8. The sealing towards this hollow space is necessary, because otherwise oil penetrating into said hollow space would be able to exit through the setting element 9, which is guided by the cylinder 8. In addition, said hollow space is variable as to its size, depending on the insert depth of the setting element 9. In the present case, the setting element 9 is a screw, which, in sections, namely at the end facing away from the screw head, has a thread 11, which positively engages with a female thread 10 of the cylinder 8. By turning the setting element 9, it turns according to the threads 10 and 11 into the cylinder 8 and thereby pushes the tenon 13, against which the setting element 9 bears, namely against the bottom thereof, in the screw-in direction of the spring 4.

Together with the tenon 9, the spring seating 14 extending from the tenon 13 moves towards the housing cover 14 of the screwed sealing plug 6 and thereby compresses the spring 4. Thus, the desired spring pretension of the spring 4 can be effected by screwing-in, respectively by pushing-in the setting element 9.

In order to facilitate sliding of the adjusting nut 7 linearly at the cylinder 8 of the screwed sealing plug 6, in the area of the spring seating, the adjusting nut 7 has surfaces 17 which allow the oil to flow therethrough to the cylinder 8 of the screwed sealing element 6.

As the push-in, respectively screw-in depth of the setting element 9 equals the movement of the adjusting nut linearly along the cylinder 8 of the screwed sealing plug 6, the adjusting of the adjusting nut and thereby the spring pretension of the spring 4 can be measured based on the plunge-in depth, respectively the screw-in depth of the setting element 9.

Figure 2:
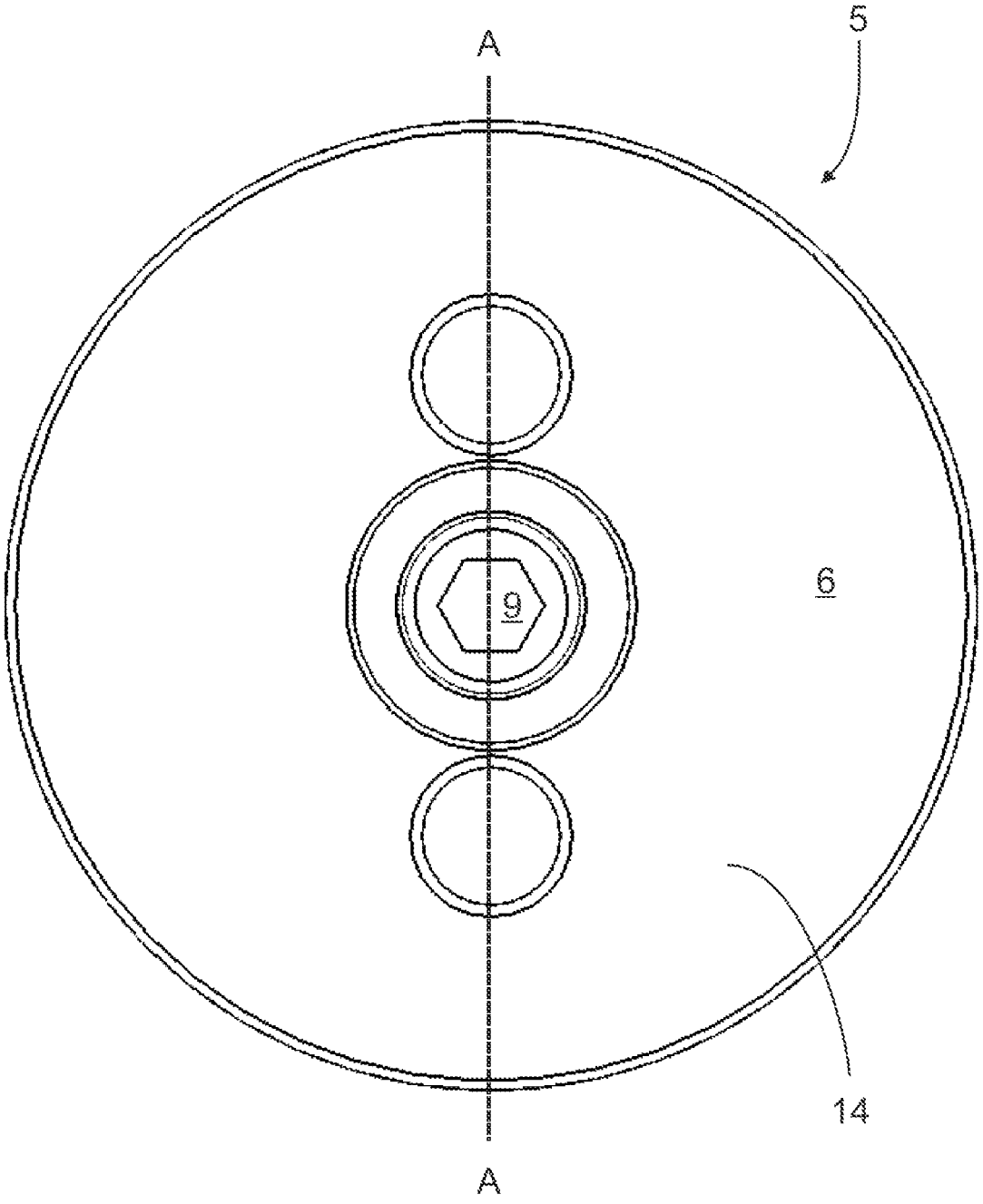
FIG. 2: shows the door actuating part in a top view along the line AA in FIG. 1, and FIG. 3: shows the spring adjusting device for the spring energy accumulator of the door actuating part of FIG. 1 in a lateral view.

FIG. 2 shows the door actuating device 1 of FIG. 1 along the line AA in a top view. The screwed sealing plug 6 is configured as a housing cover, the circumference thereof corresponding to the circumference of the housing 2 of the door actuating part 1. The setting element 9, which is executed as a screw with a hexagon socket, is guided in a centered manner in the housing cover 14 of the screwed sealing plug 6. It is evident that a spring pretension can be set with the spring 4 without any problem, which spring is supported within the housing 2 of the door actuating device 1, in this case in FIG. 2 below the housing cover 14 of the screwed sealing plug 6, by turning the setting element 9 with a hexagon socket from outside the housing 2.

As already described, in this case the setting element 9, which is supported at the adjusting nut 7, which, in this illustration is supported within the housing 2 below the housing cover 14 of the screwed sealing plug 6, pushes against the spring 4 with the spring seating 12 thereof.

Figure 3:
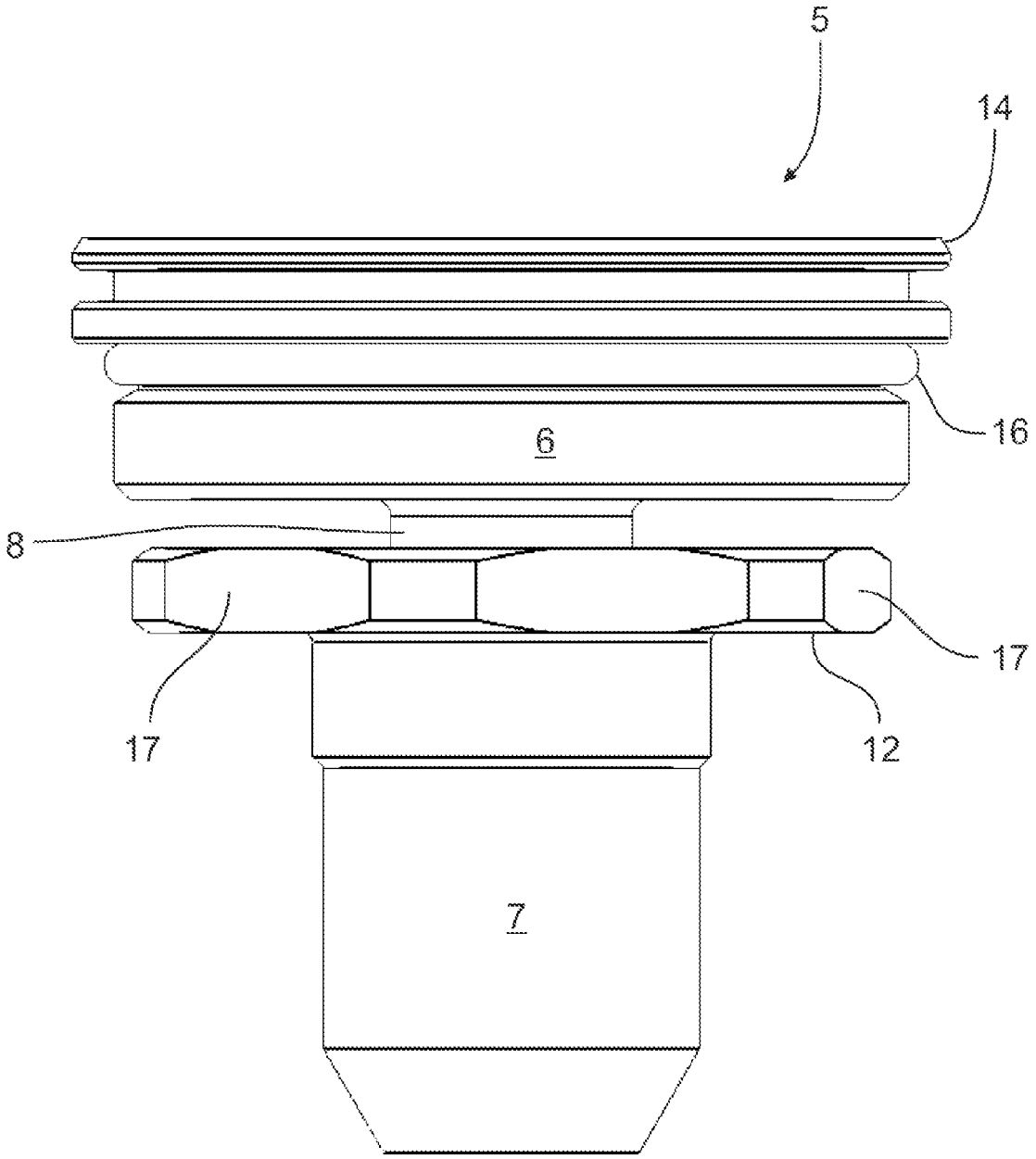

Finally, FIG. 3 shows a lateral view of the spring adjusting device 5, which essentially comprises the screwed sealing plug 6, the adjusting nut 7 and the setting element 9, wherein the setting element 9, which is guided by the screwed sealing plug 6 and which comes to bear against the adjusting nut 7, is not shown in this case in the illustration. The housing cover 14 of the screwed sealing plug 6 protrudes beyond both the gasket 16 resting against the housing cover 14 and the spring seating 12 formed by the adjusting nut 7. In this case, the circumference of the housing cover 14 is adapted to the circumference of a housing 2 of a door actuating device 1. In this case, obviously the dimension of the walling of the housing 2 determines the configuration of the gasket 16, which is located between the screwed sealing plug 6 and the interior walling of the housing 2. Below the housing cover 4 and below the gasket 16 of the screwed sealing plug 6, the screwed sealing plug 6 leads into, respectively extends into the cylinder 8. The adjusting nut 7 is formed around the cylinder 8 and is linearly guided at the cylinder 8. Above the spring seating 12, in the upper part of the adjusting nut 7, the adjusting nut has surfaces 17 for oil to flow therethrough in order to lubricate the linear guidance of the adjusting nut 7 at the cylinder 8 of the screwed sealing plug 6.

Seen from the lateral view of the spring adjusting device 5, it can be recognized that the structural dimension has been reduced to a minimum by leading the setting element 9 through the screwed sealing plug 6 and by receiving the setting element 9 in the adjusting nut 7, against which the setting element 9 comes to bear, wherein nonetheless a simple setting, i. e. a spring pretension of the spring 4 is still guaranteed by the setting element 9 via the housing cover 14 of the screwed sealing plug 6. Moreover, a verification of the adjusting displacement of the adjusting nut 7 is guaranteed in a simple manner by measuring the screw-in depth, respectively push-in depth of the setting element 9.

The invention in its configuration is not limited to the above presented preferred embodiment. On the contrary, a number of variants are conceivable, which make use of the illustrated solution, even with basically different types of embodiments. All features and/or advantages including the constructional details, spatial dispositions and potential process steps, which result from the claims, the description or the drawings, may be essential to the invention, both by themselves and in their most various combinations.

The invention claimed is:

1. A door operating device, comprising a housing, at least one drive unit which is disposed in the housing and can be coupled to a door leaf, and at least one spring energy accumulator, which is in operative connection with the drive unit, and which includes a spring disposed therein under spring pretension, wherein the spring pretension of the spring is realized by means of a spring adjusting device, which comprises at least one screwed sealing plug, which can be connected to the housing, and an adjusting nut, wherein a cylinder is configured at the screwed sealing plug and oriented towards the spring, at which cylinder the adjusting nut is linearly guided, wherein a setting element extends through the screwed sealing plug and, at least in sections, can be brought into a non-positive and positive engagement with the cylinder, and which bears against the adjusting nut, serves to adjust the spring pretension.

2. The door actuating device according to claim 1, wherein a female thread, is configured, at least in sections, in the cylinder, which thread can be brought into a positive engagement with a thread, which, at least in sections, is configured at the setting element.

3. The door actuating device according to claim 1, wherein the adjusting nut comprises a spring seating, which, at least in sections, bears against the spring.

4. The door actuating device according to claim 3, wherein, below the spring seating, the adjusting nut is formed as a tenon, which, at least partially, surrounds the cylinder of the screwed sealing plug and the setting element which is guided by the screwed sealing plug.

5. The door actuating device according to claim 4, wherein the tenon of the adjusting nut comprises a bottom against which the setting element comes to bear with one of its ends.

6. The door actuating device according to claim 4, wherein the tenon, at least in sections, extends into the spring.

7. The door actuating device according to claim 1, wherein the screwed sealing plug is configured as a housing cover for the housing.

8. The door actuating device according to claim 1, wherein measuring the push-in depth, in particular the screw-in depth of the setting element into the screwed sealing plug, in particular into the housing cover, serves for verifying the adjusting displacement of the adjusting nut.

9. The door actuating device according to claim 1, wherein the setting element is a screw.

10. The door actuating device according to claim 1, wherein the spring is a compression spring.

* * * * *